US006753662B1

(12) United States Patent
Krafft

(10) Patent No.: US 6,753,662 B1
(45) Date of Patent: Jun. 22, 2004

(54) INTENSE AND COMPACT THZ RADIATION SOURCE

(75) Inventor: Geoffrey A. Krafft, Newport News, VA (US)

(73) Assignee: Southeastern University Research Assn., Inc., Newport News, VA (US)

( * ) Notice: Subject to any disclaimer, the term of this patent is extended or adjusted under 35 U.S.C. 154(b) by 0 days.

(21) Appl. No.: 10/366,211

(22) Filed: Feb. 13, 2003

(51) Int. Cl.[7] ..... H01J 25/00
(52) U.S. Cl. ..... 315/505; 315/5.18
(58) Field of Search ..... 315/5.18, 5.41, 315/505

(56) References Cited

U.S. PATENT DOCUMENTS 4,140,942 A * 2/1979 Auslender et al. ..... 315/5.41

FOREIGN PATENT DOCUMENTS

JP 408148299 A * 6/1996

* cited by examiner

*Primary Examiner*—David Vu

(57) ABSTRACT

According to the present invention, there is provided a compact source of intense THz radiation comprising a short bunch, low energy particle beam source, an accelerator cavity and an electromagnetic wiggler. Application of state-of-the-art superconducting accelerating structures and beam recirculation allows such a THz radiation source to have a small footprint and high average intensity without the need of the larger equipment necessary to produce the large charge per bunch generally associated with the production of THz radiation. Consequently, low emittance electron beams can be used to produce emitted THz radiation of high average brilliance.

15 Claims, 1 Drawing Sheet

INTENSE AND COMPACT THZ RADIATION SOURCE

FIELD OF THE INVENTION

The present invention relates to methods and apparatus for the generation of terahertz (THz) radiation and more particularly to compact apparatus for the generation of such radiation.

BACKGROUND OF THE INVENTION

The THz region (1 THz=33 $cm^{-1}$ or 4 meV) lies in the far infrared spectral range where conventional thermal sources are very weak. For example, a blackbody source at 2,000° K. provides less than 1 $\mu$W per $cm^{-1}$ of spectral power density for a typical spectroscopy application. Such radiation offers great promise for use in many Important fields, for example diagnostic applications such as the observation of melanoma as well as security systems that rely on imaging of persons or packages that do not submit well to other forms of imaging such as X-ray imaging.

While THz radiation is well known and has been produced in many environments, the generation of such radiation normally requires large pieces of equipment such as particle accelerators or free electron lasers to obtain the energies required to produce such radiation. For example, a free electron laser capable of producing the required high energy input beam (50 MeV) for such a device may be up to 60 feet long. The need for such large devices has limited significantly the use of THz radiation in applications other than those with ready access to such large pieces of equipment. Thus, it would be highly desirable to provide a method and device for the production of intense THz radiation that is of compact size and therefore more readily utilized In areas remote from the large devices usually associated with the production of THz radiation.

OBJECT OF THE INVENTION

It is therefore an object of the present invention to provide a compact device capable of producing intense THz radiation.

SUMMARY OF THE INVENTION

According to the present invention, there is provided a compact source of intense THz radiation comprising a short bunch, low energy particle beam source, an accelerator cavity and an electromagnetic wiggler. Application of state-of-the-art superconducting accelerating structures and beam recirculation allows such a THz radiation source to have a small footprint and high average intensity without the need of the larger equipment necessary to produce the large charge per bunch generally associated with the production of THz radiation. Consequently, low emittance electron beams can be used to produce emitted THz radiation of yield high average brilliance.

DETAILED DESCRIPTION

Figure 1:
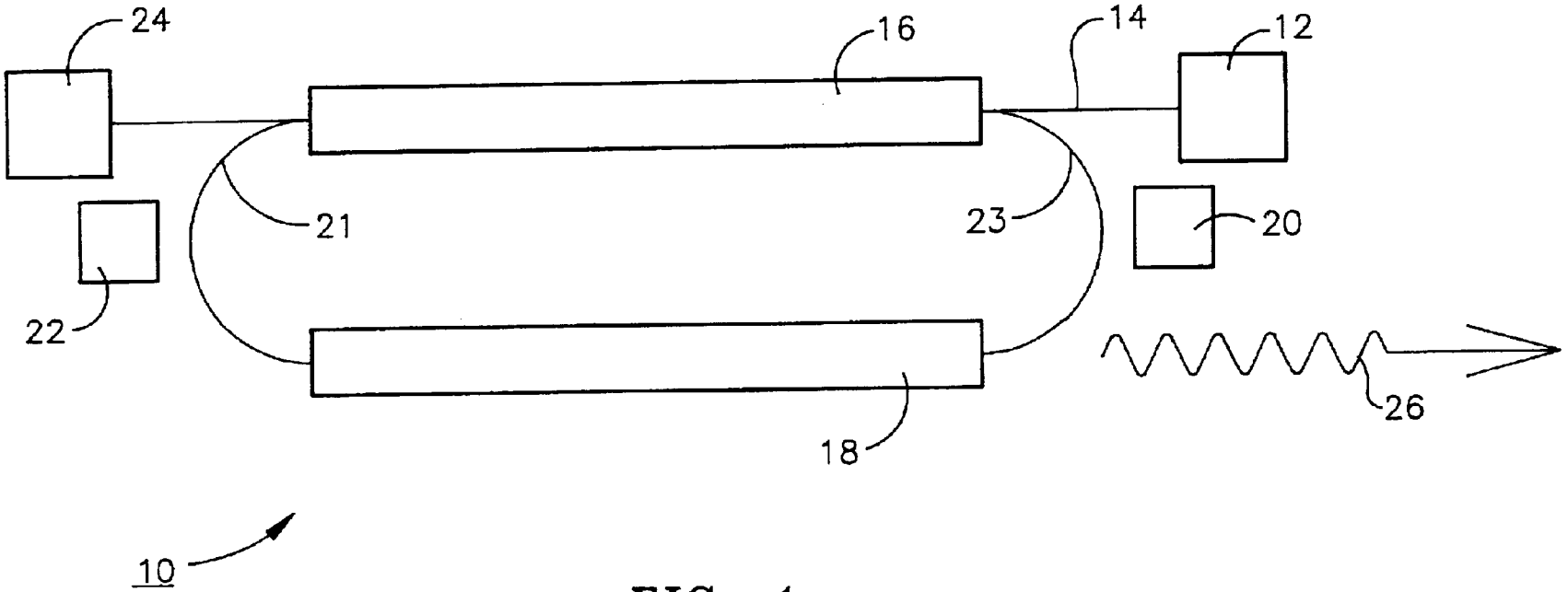
FIG. 1 is a schematic drawing of the THz production apparatus of the present invention.

Referring now to FIG. 1, the compact THz radiation generator 10 of the present invention comprises an electron beam generator 12 such as a thermionic gun that generates a beam 14, a small/compact linac 16 described more fully below, and a wiggler or undulator 18. Magnets 20 and 22 permit bending of beams 21 (beam 14 after acceleration by linac 16) and 23 (beam 21 after treatment by wiggler/undulator 18) to permit circulation thereof through the compact system. An electron dump 24 is provided to permit extraction of excess beam electrons. THz radiation 26 is extracted from compact system 10 as beam 23 is bent by magnet 20 in the conventional fashion.

Thermionic gun or other low energy particle beam source 12 such as a laser preferably demonstrates the capability of generating a beam having an energy between about 100 and about 500 KeV, a charge of between about 1 and about 10 pico coulombs and a repetition rate of about 500 to about 3000 MHz at a current of less than about 30 milliamps and an emittance of <20 mm mrad.

Linac 16 can comprise a single superconducting cavity as short as one meter long or a series of such compact cavities. Such cavities are well known in the art and are those currently in use at the Jefferson National Laboratory in Newport News, Va. Such compact superconducting cavities are capable of delivering up to about 10 million volts over their one-meter length. As beam 21 enters wiggler/undulator 18 it should exhibit the following properties: an energy of from about 10 to about 20 MeV, a pulse duration of less than about 100 $\mu$m, a normalized emittance of less than about 20 mm mrad, a charge of from about 1 to about 10 pico coulombs and a repetition rate of between about 500 and about 3000 MHz Wiggler/undulator 18 is of conventional design and construction and should demonstrate the following properties: $\gamma_w$ of about 3 cm, $N_p$ of about 50 and a field K of about 1 Tesla.

In operation, a particle beam 14 having the properties described hereinabove is produced by electron source/thermionic gun 12, accelerated through linac cavity 16 to the energy previously described to produce beam 21 that is in turn inserted into wiggler/undulator 18 to produce beam 23 that is bent by magnet 20 to yield THz radiation 26. As depicted in FIG. 1, the use of magnet 22 to bend beam 21 for introduction into wiggler/undulator IS and magnet 20 to permit introduction of beam 23 back into linac 16 provide for beam recirculation and enhancement without the need for additional footprint. Such an arrangement contributes significantly to the efficiency of apparatus 10 and permits continuous power enhancement of beam 23 as it makes its way about the circular geometry of the system.

Since each of the individual components of the compact THz radiation production device described herein are well known to those skilled in the particle acceleration and handling arts, no further description of the individual components or there construction is necessary herein. It the combination of these individual components into a compact recirculating THz radiation production system that constitutes the invention described herein.

As the invention has been described, it will be apparent to those skilled in the art that the same may be varied in many ways without departing from the spirit and scope of the invention. Any and all such modifications are intended to be included within the scope of the appended claims.

What is claimed is:

1. A compact apparatus for the production of intense THz radiation comprising;

a) a particle beam source that generates a short bunch particle beam having an energy between about 100 and about 500 KeV, a charge of between about 1 and about 10 pico coulombs, a repetition rate of from about 500 to about 3000 MHz at a current of less than about 30 milliamps and an emittance of <20 mm mrad, b) a linac comprising one or a series of compact superconducting cavities that are capable of delivering up to about 10 million volts that accelerates said beam as it is received from said particle beam source;

c) a wiggler/undulator that receives said beam from said linac and exhibits the following properties: $\gamma_w$ of about 3 cm, $N_p$ of about 50 and a field K of about 1 Tesla; and d) a magnet that bends said particle beam as it exits said wiggler/undulator thereby permitting extraction of THz radiation therefrom.

2. The compact apparatus of claim 1 wherein said linac and said wiggler/undulator are located parallel to each other, said magnet bends said particle beam back into said linac as it exits said wiggler/undulator and further including a second magnet that directs the particle beam into the wiggler/undulator as it exits the linac.

3. The compact apparatus of claim 2 wherein said linac comprises one superconducting cavity.

4. The compact apparatus of claim 3 wherein said linac is about one meter in length.

5. The compact apparatus of claim 2 further including an electron dump that permits removal of unsuitable electrons from said beam as it exits said linac.

6. The compact apparatus of claim 2 wherein said particle beam source is a thermionic gun.

7. The compact apparatus of claim 2 wherein said particle beam source is a laser.

8. A method for the production of intense THz radiation comprising:

a) producing a short bunch particle beam having an energy between about 100 and about 500 KeV, a charge of between about 1 and about 10 pico coulombs, a repetition rate of between about 500 to about 3000 MHz at a current of less than about 30 milliamps and an emittance of <20 mm mrad, b) introducing said particle beam Into a linac comprising one or a series of compact superconducting cavities that are capable of delivering up to about 10 million volts to accelerate said beam and produce an accelerated beam;

c) introducing said accelerated beam into a wiggler/undulator that exhibits the following properties: $\gamma_w$ of about 3 cm, $N_p$ of about 50 and a field K of about 1 Tesla; and d) magnetically bending said accelerated beam as it exits said wiggler/undulator thereby permitting extraction of THz radiation therefrom.

9. The method of claim 8 wherein said linac and said wiggler/undulator are located parallel to each other, said bending of the particle beam directs the particle beam back into the linac as it exits said wiggler/undulator and further including the step of magnetically bending the accelerated particle beam into the wiggler/undulator as it exits the linac.

10. The method of claim 9 wherein said linac comprises one superconducting cavity.

11. The method of claim 9 wherein said linac is about one meter in length.

12. The method of claim 8 wherein said particle beam is generated by a thermionic gun.

13. The method of claim 9 wherein said particle beam is generated by a laser.

14. The method of claim 9 wherein said particle beam is generated by a thermionic gun.

15. The method of claim 9 wherein said particle beam is generated by a laser.

* * * * *